US012352006B2

(12) United States Patent
Shin et al.

(10) Patent No.: US 12,352,006 B2
(45) Date of Patent: Jul. 8, 2025

(54) CONSTRUCTION EQUIPMENT

(71) Applicant: Volvo Construction Equipment AB, Eskilstuna (SE)

(72) Inventors: Hungju Shin, Gyeongsangnam-do (KR); Miok Kim, Busan (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 224 days.

(21) Appl. No.: 17/897,723

(22) Filed: Aug. 29, 2022

(65) Prior Publication Data

US 2023/0066218 A1 Mar. 2, 2023

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/22*** | (2006.01) |
| ***E02F 9/26*** | (2006.01) |

(52) U.S. Cl.

CPC ..... *E02F 3/435* (2013.01); *E02F 3/32* (2013.01); *E02F 9/2004* (2013.01); *E02F 9/2228* (2013.01); *E02F 9/262* (2013.01)

(58) Field of Classification Search

CPC . E02F 3/435; E02F 3/32; E02F 9/2004; E02F 9/2228; E02F 9/262; E02F 3/437; E02F 9/2033; E02F 9/2045; E02F 9/26

See application file for complete search history.

(56) References Cited

U.S. PATENT DOCUMENTS

| | | | | |
|---|---|---|---|---|
| 2016/0215475 | A1* | 7/2016 | Meguriya | E02F 9/2285 |
| 2017/0284070 | A1* | 10/2017 | Matsuyama | E02F 9/20 |
| 2020/0232186 | A1 | 7/2020 | Nakano et al. | |
| 2021/0010229 | A1* | 1/2021 | Sano | E02F 9/265 |
| 2022/0145580 | A1* | 5/2022 | Igarashi | E02F 9/2029 |
| 2022/0178113 | A1 | 6/2022 | Kim et al. | |
| 2022/0213664 | A1* | 7/2022 | Albers | F15B 15/20 |
| 2023/0358014 | A1* | 11/2023 | Narikawa | E02F 9/2033 |

FOREIGN PATENT DOCUMENTS

| | | | |
|---|---|---|---|
| JP | H0794735 | B2 | 10/1995 |
| WO | 2020195262 | A1 | 10/2020 |
| WO | 2020204240 | A1 | 10/2020 |

OTHER PUBLICATIONS

Extended European Search Report for European Patent Application No. 22191916.0, mailed Feb. 10, 2023, 8 pages.

* cited by examiner

*Primary Examiner* — Anne Marie Antonucci
*Assistant Examiner* — Patrick Daniel Mohl
(74) *Attorney, Agent, or Firm* — Sage Patent Group

(57) ABSTRACT

A construction equipment includes a work machine which includes a boom, an arm, and a bucket operated by their respective hydraulic cylinder. The construction equipment also includes a control valve for controlling the hydraulic cylinder; an operation lever for outputting an operation signal corresponding to an operation amount of a driver; a work setting unit for setting a work area; a location information providing unit; and an electronic control unit. The electronic control unit is for outputting a control signal for the control valve according to the signal inputted from at least one of the operation lever, the work setting unit, and the location information providing unit. The electronic control unit calculates an angle between the work area and the work machine, and controls a speed of the work machine based on the calculated angle.

10 Claims, 7 Drawing Sheets

(a)

(b)

CONSTRUCTION EQUIPMENT

CROSS REFERENCE TO RELATED APPLICATIONS

The present application claims benefit of priority to Korean Patent Application No. 10-2021-0116443, filed Sep. 1, 2021, and is assigned to the same assignee as the present application and is incorporated herein by reference.

TECHNICAL FIELD

The present disclosure relates to a constitution equipment. More specifically, the present disclosure relates to a construction equipment which controls a speed of a bucket in consideration of a turning radius of a work machine and an angle with respect to a work area, thereby having a work area limit function that improves work speed and work efficiency.

BACKGROUND

In general, an excavator is a construction equipment performing various tasks such as digging for digging up the ground at construction sites, etc. loading for carrying soil, excavating for making a foundation, crushing for dismantling buildings, grading for cleaning the ground, and leveling for leveling the ground.

SUMMARY

An embodiment of the present disclosure provides a construction equipment, comprising a lower traveling body; an upper rotating body rotatably supported on the lower traveling body; a work machine which comprises a boom, an arm, and a bucket operated by their respective hydraulic cylinder, wherein the work machine is supported by the upper rotating body; a control valve for controlling the hydraulic cylinder; an operation lever for outputting an operation signal corresponding to an operation amount of a driver; a work setting unit for setting a work area of the work machine; a location information providing unit for providing at least one of location information and posture information of the work machine and location information of the work area; and an electronic control unit for outputting a control signal for the control valve according to the signal inputted from at least one of the operation lever, the work setting unit, and the location information providing unit, wherein the electronic control unit calculates an angle between the work area and the work machine, and controls a speed of the work machine based on the calculated angle.

According to an embodiment, when the operation signal of the operation lever is inputted, the electronic control unit may determine whether the turning radius of the work machine is likely to invade the work area and limits the speed of the work machine only when the work machine is likely to invade the work area.

According to an embodiment, the electronic control unit may compare the turning radius with a shortest distance between a rotating center of the work machine and the work area to limit the speed of the work machine when the turning radius is greater than the shortest distance.

According to an embodiment, the turning radius may be a line connecting the rotating center and a distal end of the bucket.

According to an embodiment, the rotating center may be at least one of a boom pin, an arm pin and a bucket pin.

According to an embodiment, the electronic control unit may control the speed of the work machine based on an angle remaining to the work area of the work machine.

According to an embodiment, the electronic control unit may determine to be in a speed limit section when a difference between a current angle of the work machine for the work area and an angle of the work machine for the work area when the bucket invades the work area is less than or equal to a predetermined reference value.

According to an embodiment, the electronic control unit may set a deceleration rate of the work machine in the speed limit section, and limit the speed of the work machine based on the set deceleration rate.

According to an embodiment, the electronic control unit may set the speed limit section and/or deceleration rate based on the difference in angle.

According to an embodiment, the location information providing unit may comprise at least one of a location measurement unit for measuring location information of the construction equipment, a posture measurement unit for measuring posture information of the construction equipment and posture of each work machine, and a coordinate calculation unit for calculating coordinates based on the location information measured from the location measurement unit and the posture measurement unit.

According to an embodiment, the operation lever may generate an electric signal in proportional to the operation amount of the driver as an electric joystick to provide the same to the electronic control unit.

According to an embodiment, the work setting unit may comprise a plurality of work mode setting functions which can be set as needed by the driver, and display on a display screen at least one of geographic information and location information provided from the location information providing unit, and posture information of the construction equipment according to the work mode setting.

According to an embodiment, whether to initiate the speed control of the bucket is determined based on the turning radius of the work machine, and the distance between the work machine and the work area. Therefore, even when the bucket is located to be close from the work area, if the turning radius of the work machine is not likely to invade the work area, since the speed of the bucket is not limited by force, the work of a worker may be naturally linked.

When the speed of the bucket is controlled based on the angular difference, which is a difference between a current angle for a work surface of the bucket and an angle for the work surface of the bucket when the bucket invades the work area, it is possible to operate the bucket more efficiently when there is a lot of time left for the bucket to invade the work area depending on the posture of the bucket during the excavation of the bucket.

The effects of the present disclosure are not limited to the above-mentioned effects, and it should be understood that the effects of the present disclosure include all effects that could be inferred from the configuration of the disclosure described in the detailed description of the disclosure or the appended claims.

DETAILED DESCRIPTION

Figure 1:
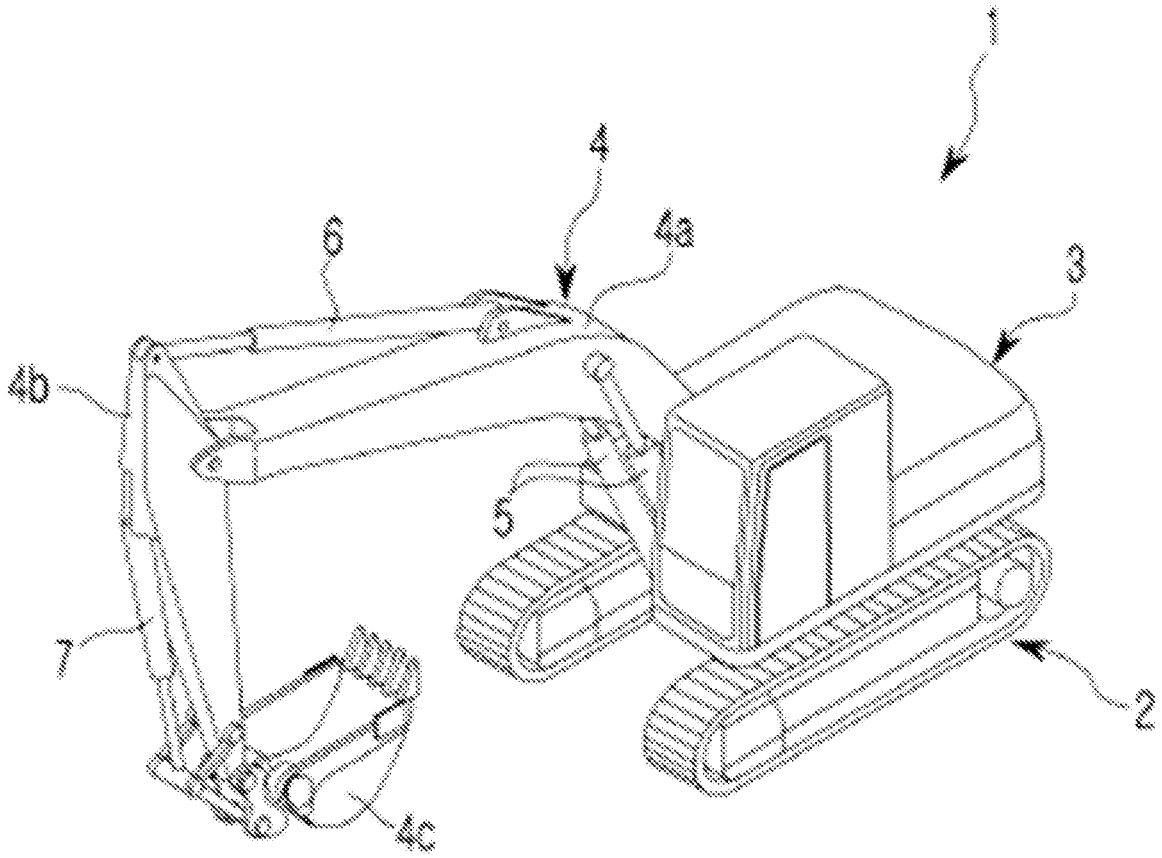
FIG. 1 is a perspective view illustrating a basic configuration of a construction equipment.

The present disclosure is to solve the above-mentioned problem of the prior art. It is an object of the present disclosure to provide a construction equipment which controls a speed of a bucket in consideration of an angle between the bucket and a work area, thereby having a work area limit function that improves work speed and work efficiency.

Hereinafter, the present disclosure will be explained with reference to the accompanying drawings. The present disclosure, however, may be modified in different ways, and should not be construed as limited to the embodiments set forth herein. Also, in order to clearly explain the present disclosure in the drawings, portions that are not related to the present disclosure are omitted, and like reference numerals are used to refer to like elements throughout the specification.

Throughout the specification, it will be understood that when a portion is referred to as being "connected" to another portion, it can be "directly connected to" the other portion, or "indirectly connected to" the other portion having intervening portions present. Also, when a component "includes" an element, unless there is another opposite description thereto, it should be understood that the component does not exclude another element but may further include another element.

The term including an ordinal number like "the first" or "the second" used throughout the specification of the present disclosure may be used to explain various constitutional elements or steps, but the corresponding constitutional elements or steps should not be limited by the ordinal number. The term including the ordinal number should be interpreted only for distinguishing one constitutional element or step from other constitutional elements or steps.

Hereinafter, embodiments of the present disclosure will be explained in detail with reference to the drawings attached.

Referring to FIG. 1, a construction equipment 1 like an excavator comprises a lower traveling body 2, an upper rotating body 3 rotatably installed on the lower traveling body 2, and a work machine 4 installed to vertically operate on the upper rotating body 3.

Additionally, the work machine 4, formed in multi-joints, comprises a boom 4*a* whose rear end is rotatably supported in the upper rotating body 3, an arm 4*b* whose rear end is rotatably supported in the front end of the boom 4*a*, and a bucket 4*c* rotatably installed in the front end of the arm 4*b*. Additionally, hydraulic oil is supplied according to a lever operation of a user, and a boom cylinder (5, work actuator), an arm cylinder (6, work actuator), and a bucket cylinder (7, work actuator) operate the boom 4*a*, the arm 4*b*, and the bucket 4*c*, respectively.

The construction equipment 1 as above operates a work machine 4 such as a boom 4*a*, an arm 4*b*, a bucket 4*c*, etc. by a manual operation lever thereof. However, since each of the work machine 4 is connected by a joint part to perform a rotating movement, it requires considerable efforts for a driver to operate each work machine 4 to work a prescribed area.

Therefore, in order to easily perform this work, an apparatus for controlling the work area of an excavator is suggested in Japanese Patent No. Hei7-94735. The apparatus for controlling the work area controls the movement of a bucket 4*c* according to the distance between a distal end A of the bucket 4*c* and a boundary line of a non-invasive area. Accordingly, even when a driver unintentionally moves a distal end A of the bucket 4*c* to a non-invasive area, the bucket 4*c* is automatically stopped at the boundary line of the non-invasive area. The driver may recognize that the work machine 4 is approaching a non-invasive area from the fact that the work machine 4 is slowing down during work, and turn back the front end of the bucket 4*c*.

Figure 2:
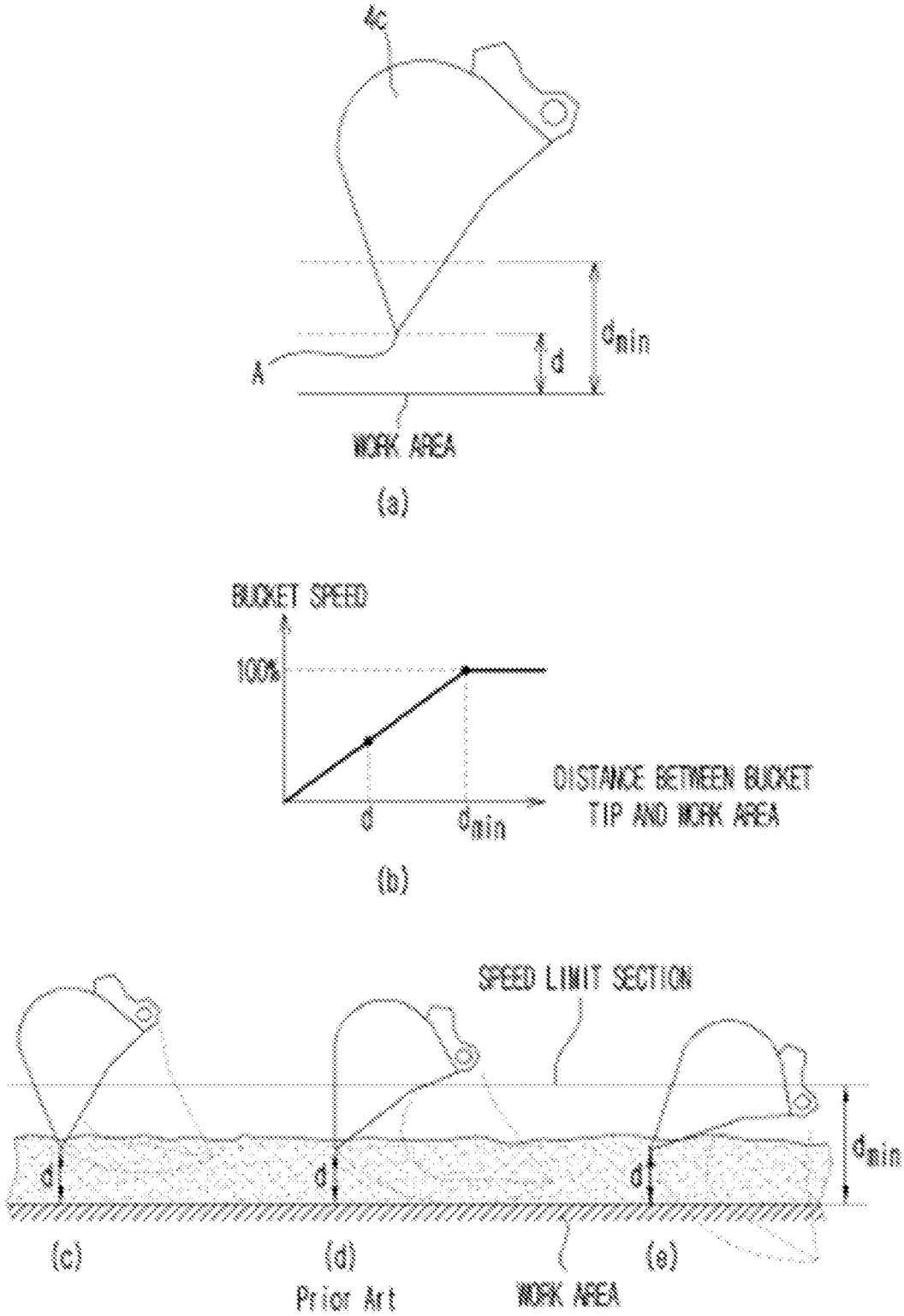
FIG. 2 is a schematic diagram illustrating a method for controlling the speed of a work machine according to the prior art.

FIG. 2 (*c*) to (*e*) illustrate situations in which the posture of the bucket 4*c* is different from each other but the distance between the distal end A of the bucket 4*c* and the work area is the same in a situation where the driver sets a work area and then clears away the work material piled up in the work area.

In this case, in order for the driver to clear away the work material piled up in the set work area, the bucket 4*c* needs to be operated. According to the prior art, the speed of the bucket 4*c* is limited only by a shortest distance d between the distal end A of the bucket 4*c* and the work area. However, even when the shortest distance d between the distal end A of the bucket 4*c* and the work area is the same, depending on the posture of the bucket 4*c*, there may be a situation where the bucket 4*c* does not invade the work area or there is a lot of time left for the bucket 5*c* to invade the work area. Even for such cases, according to the prior art, the speed of the bucket 4*c* is limited in the same way.

In other words, unlike situation (e), in situations (c) and (d), even when the driver operates the bucket 4*c*, the bucket 4*c* does not invade the work area. However, even for such cases, the shortest distance d between the distal end of the bucket 4*c* and the work area is recognized to be the same, and thus the speed of the bucket 4*c* is limited in the same manner as situation (e). Accordingly, the work speed and efficiency deteriorate during the excavation work using the bucket 4*c*.

In order to solve the above-mentioned problem, WO 2020/204240 suggests a construction equipment which controls the speed of the bucket 4*c* in consideration of the distance between the distal end of the bucket 4*c* and the work area in the speed direction of the distal end of the bucket 4*c*. Meanwhile, like the prior art, even when the bucket 4*c* is not likely to invade the work area, the speed of the bucket 4*c* was limited when the bucket 4*c* is close to a work surface, and the distance between the distal end of the bucket 4*c* and the work area is small in the speed direction of the distal end of the bucket 4*c*.

Figure 3:
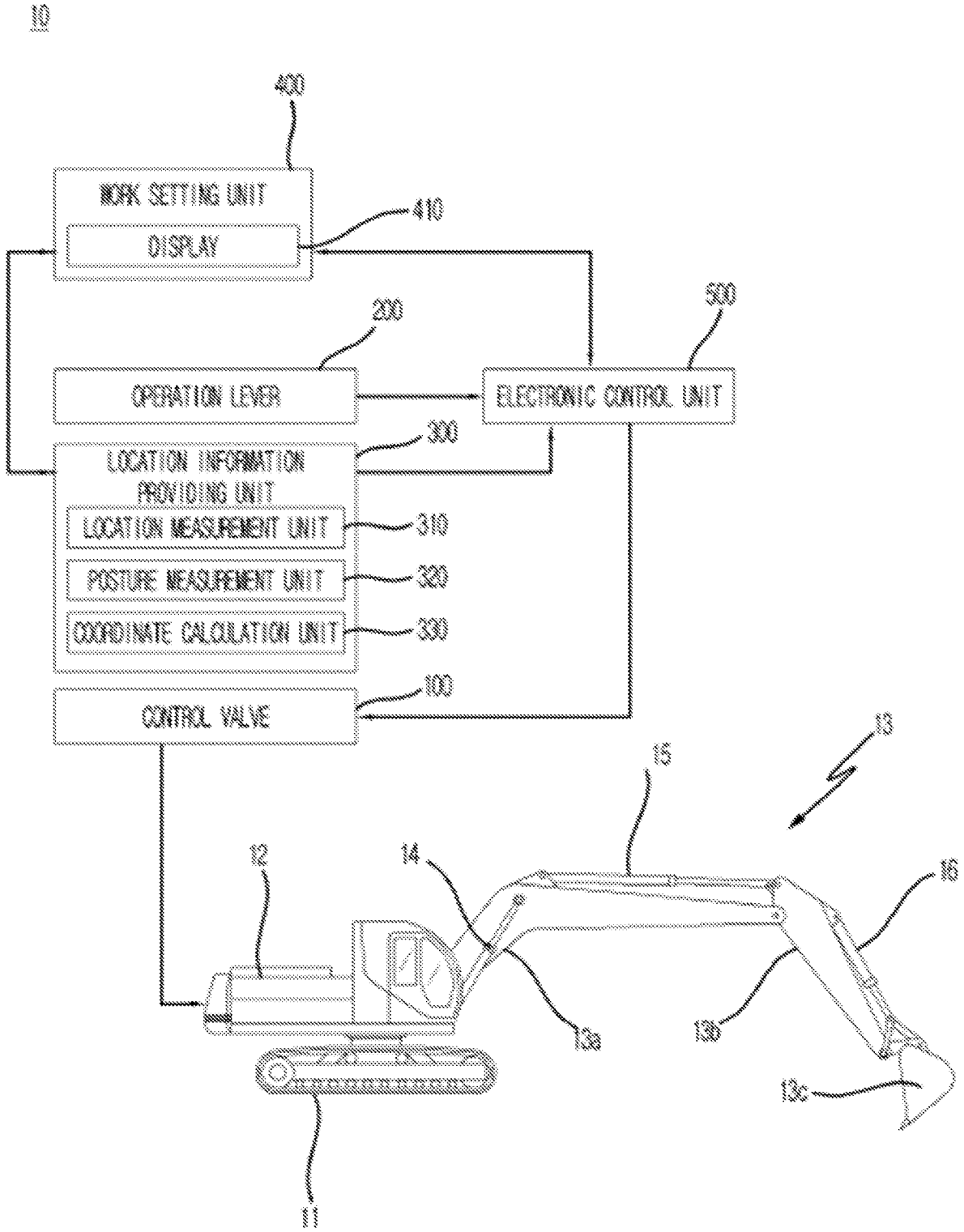
FIG. 3 is a schematic diagram illustrating a work area limit function of the construction equipment according to an embodiment of the present disclosure.
Figure 4:
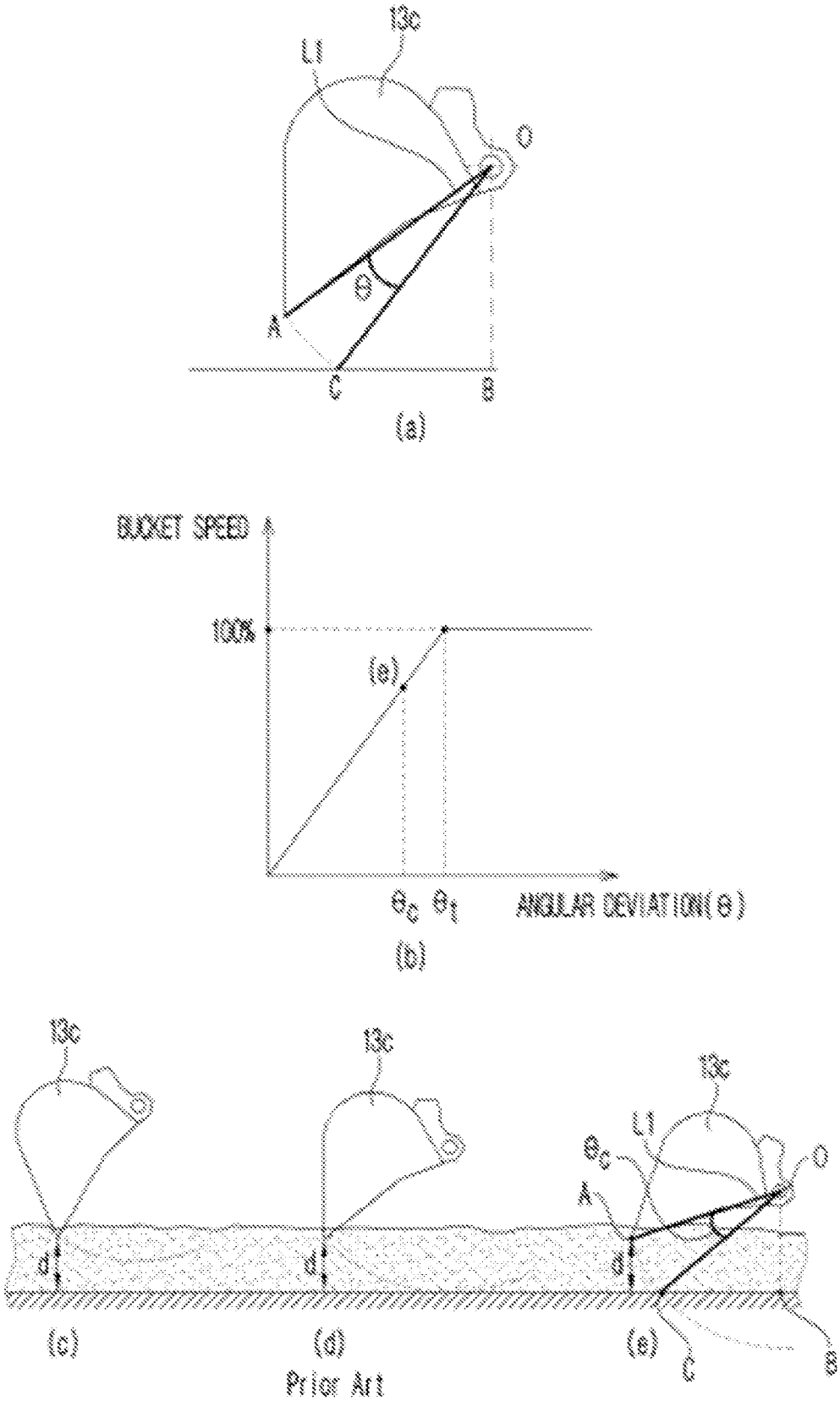
FIG. 4 is a schematic diagram illustrating a method for controlling the speed of the work machine during a bucket-in operation according to an embodiment of the present disclosure.

FIG. 3 is a schematic diagram illustrating a work area limit function of the construction equipment according to an embodiment of the present disclosure. FIG. 4 is a schematic diagram illustrating a method for controlling the speed of the work machine during a bucket-in operation according to an embodiment of the present disclosure.

Referring to FIGS. 3 and 4, a construction equipment 10 with a work area limit function according to embodiments of the present disclosure comprises a lower traveling body 11; an upper rotating body 12 rotatably supported on the lower traveling body 11; a work machine 13 which comprises a boom 13*a*, an arm 13*b*, and a bucket 13*c* operated by their respective hydraulic cylinder, wherein the work machine 13 is supported by the upper rotating body 12; a control valve 100 for controlling the hydraulic cylinder; an operation lever 200 for outputting an operation signal corresponding to an operation amount of a driver; a work setting unit 400 for setting and/or selecting a work area of the work machine 13; a location information providing unit 300 for collecting and/or calculating location information and posture information of the work machine 13 and/or location information of the work area, and an electronic control unit 500 for outputting a control signal for the control valve 100 according to a signal inputted from at least one of the operation lever 200, the work setting unit 400 and the location information providing unit 300.

In this case, the electronic control unit 500 according to an embodiment of the present disclosure is configured to calculate an angle between the work machine 13 and the work area, and control the speed of the work machine 13 based on the calculated angle.

The control valve 100 is a member for opening and closing a flow path by spool which moves axially by receiving pressure. In other words, the control valve 100 serves a role of converting a supplying direction of the hydraulic oil supplied by a hydraulic pump which is a hydraulic source towards the hydraulic cylinder. The control valve 100 is connected to the hydraulic pump through a hydraulic pipe and induces the supplying of the hydraulic oil to the hydraulic cylinder from the hydraulic pump.

The operation lever 200 may be a hydraulic joystick or an electric joystick, and preferably may be an electric joystick which generates an electric signal in proportional to the operation amount of the driver and provides the same to the electronic control unit 500.

Whether the work machine 13 is likely to invade the set work area may be determined by comparing the turning radius of the work machine 13 with the distance between the work machine 13 and the work area. For example, when the turning radius of the work machine 13 is smaller than the shortest distance between the rotating center and the work area, it is determined that the work machine 13 is not likely to invade the set work area, and thereby the speed of the work machine 13 may not be limited.

Meanwhile, when the turning radius of the work machine 13 is greater than the shortest distance between the rotating center of the work machine 13 and the work area, it is determined that the work machine 13 is likely to invade the set work area, and thereby the speed of the work machine 13 may be limited.

Preferably, even when the turning radius of the work machine 13 is the same as the shortest distance between the rotating center of the work machine 13 and the work area, the speed of the work machine 13 may not be limited.

The location information providing unit 300 may comprise a location measurement unit for receiving a signal transmitted from a global positioning system (GPS) satellite to measure location information of the construction equipment 10, a posture measurement unit for measuring posture information of the construction equipment 10 and the posture of at least one of the boom 13*a*, the arm 13*b*, and the bucket 13*c*, and a coordinate calculation unit for calculating coordinates of the construction equipment 10 based on the location information measured from the location measurement unit and the posture measurement unit.

The location measurement unit 310 may comprise a receiver capable of receiving a signal transmitted from the GPS satellite, and measure location information of the construction equipment 10 from the received signal.

The posture measurement unit 320 measures the location and/or posture of at least one of the boom 13*a*, the arm 13*b*, and the bucket 13*c*, and a body gradient, etc. of the construction equipment 10 by using a plurality of inertial measurement units, angle sensors, etc.

The coordinate calculation unit 330 calculates at least one x, y, z coordinates of the boom 13*a*, the arm 13*b*, and the bucket 13*c* by using the location information and posture information measured from the location measurement unit 310 and the posture measurement unit 320.

Additionally, the location information providing unit 300 may further comprise a mapping unit for mapping geographic information around the work location and construction information for the work location on the calculated coordinate. The mapping unit adjusts and maps the location and/or posture of each work machine 13 measured from the posture measurement unit and the body gradient, etc. of the construction equipment 10 according to each axis calculated in the coordinate calculation unit.

The work setting unit 400 may set and/or select the work area of the work machine 13, and provide plane information of the work area set and/or selected. Additionally, the work setting unit 400 may comprise work mode functions which can be variously set and/or selected as needed by the driver such as bucket posture control mode, work area limit mode, swing position control mode, etc.

The work setting unit 400 may display, on a display 410 screen, at least one of the geographic information and location information provided from the location information providing unit 300, the posture information of the construction equipment 10, and the plane information of the work area W set in the work setting unit 400, according to the setting and/or selection of the work area and/or the work mode.

In other words, the driver may set and/or select the work area and/or work mode on the display 410 screen, and accordingly easily work by using the displayed information. In this case, the work area means a design surface that the driver aims to work.

The electronic control unit 500 determines whether the current work machine 13 is likely to invade the set work area when the operation signal of the operation lever 200 is inputted. When it is determined that the work machine 13 is likely to invade the set work area, a difference between an angle between the work machine 13 and the set work area, and an angle when the work machine 13 invades the set work area is calculated. Next, the calculated angular deviation θ is compared with a predetermined reference value θt to determine a speed limit of the work machine 13. Finally, a control signal is outputted to the control valve 100 which controls the hydraulic cylinder based on the speed limit.

In other words, when the work area limit function according to the present disclosure is activated, the operation signal of the operation lever 200 and/or various location information of the location information providing unit 300 are inputted to the electronic control unit 500. Additionally, the electronic control unit 500 determines the speed limit of the work machine 13 based on the information collected, and accordingly controls the movement of the work machine 13.

Referring to FIGS. 3 and 4, the construction equipment with the work area limit function according to an embodiment of the present disclosure is operated in the following manner.

First, the driver selects an active control mode on the work setting unit 400, and sets a target work area. Additionally, the driver operates the bucket-in operation lever 200 for the excavation work of the bucket 13*c* for the work area.

In this regard, the location information providing unit 300 collects and/or calculates the location information and posture information of the work machine 13 and/or location information of the set work area, and provides the same to the electronic control unit 500. The electronic control unit 500 determines whether the work machine 13 is likely to invade the set work area based on the location information and posture information provided from the location information providing unit 300 and/or the location information of the set work area. Preferably, the electronic control unit 500 compares the turning radius of the bucket 13*c* with the distance between the rotating center of the bucket 13*c* and the work area.

Specifically, FIG. 4(*c*) illustrates a case where the distance from a bucket pin O to the bucket end A, which is the turning radius L1 of the bucket 13*c*, is smaller than the distance between the bucket pin O, which is the rotating center of the bucket 13*c*, and the shortest point B to the work area. FIG. 4(*d*) illustrates a case where the turning radius L1 of the bucket 13*c* is the same as the shortest distance between the rotating center O of the bucket 13*c* and the work area. FIG. 4(*e*) illustrates a case where the turning radius L1 of the bucket 13*c* is greater than the shortest distance between the rotating center O of the bucket 13 and the work area.

The shortest distance d between the distal end A of the bucket 13*c* and the work area is the same in postures of FIGS. 4(*c*), 4(*d*) and 4(*e*). However, in case of FIGS. 4(*c*) and 4(*d*), since the turning radius L1 is the same as or smaller than the shortest distance between the rotating center O and the work area, the work machine is not likely to invade the work area even when the bucket 13*c* is operated. Nevertheless, when the speed of the bucket 13*c* is limited based on the shortest distance d between the distal end A of the bucket 13*c* and the work area, the work speed and efficiency during the excavation work using the bucket 13*c* may deteriorate.

Therefore, it is necessary to compare the turning radius L1 of the work machine 13 with the distance between the work machine 13 and the work area to limit the speed of the bucket 13*c* only when the turning radius L1 of the work machine 13 is greater than the distance between the work machine 13 and the work area as illustrated in FIG. 4(*e*).

As such, when the electronic control unit 500 compares the turning radius of the work machine 13 with the distance between the work machine 13 and the work area to control the speed of the bucket 13*c*, even when the bucket 13*c* is located to be close from the work area, if the turning radius of the work machine 13 is not likely to invade the work area, since the speed of the bucket 13*c* is not limited by force, the work of a worker may be naturally linked.

Meanwhile, when it is determined that the bucket 13*c* is likely to invade the work area because the turning radius of the bucket 13*c* is greater than the shortest distance between the rotating center O of the bucket 13*c* and the work area, the speed of the bucket 13*c* may be controlled based on the angle remaining until the bucket 13*c* invades the work area. In other words, as illustrated in FIG. 4(*b*), the speed of the bucket 13*c* may be controlled based on the deviation between a current angle of the bucket 13*c* for the work area and an angle of the bucket 13*c* when invading the work area.

The electronic control unit 500 calculates angular deviation θ (∠AOC), which is a difference between an angle ∠AOB of the current rotating center O of the bucket 13*c*, the distal end A of the bucket 13*c*, and shortest point B of the work area, and an angle ∠COB of the rotating center O of the bucket 13*c*, the distal end A of the bucket 13*c* and a point C that first invades the work area when the bucket 13*c* rotates, based on location information of the work machine 13 provided from the location information providing unit 300 and/or the location information of the set work area, and then compares the angular deviation θ with the predetermined reference value θt. In this case, the predetermined reference value θt may be, for example, 15°, but is not limited thereto.

The electronic control unit 500 determines that the speed of the bucket 13*c* does not have to be limited when the angular deviation θ exceeds the predetermined reference value θt. In other words, in this case, the electronic control unit 500 does not limit the speed of the bucket 13*c*.

Meanwhile, the electronic control unit 500 determines to be in a speed limit section when the angular deviation θc is less than or equal to the reference value θt as illustrated in FIG. 4(*c*).

Figure 6:
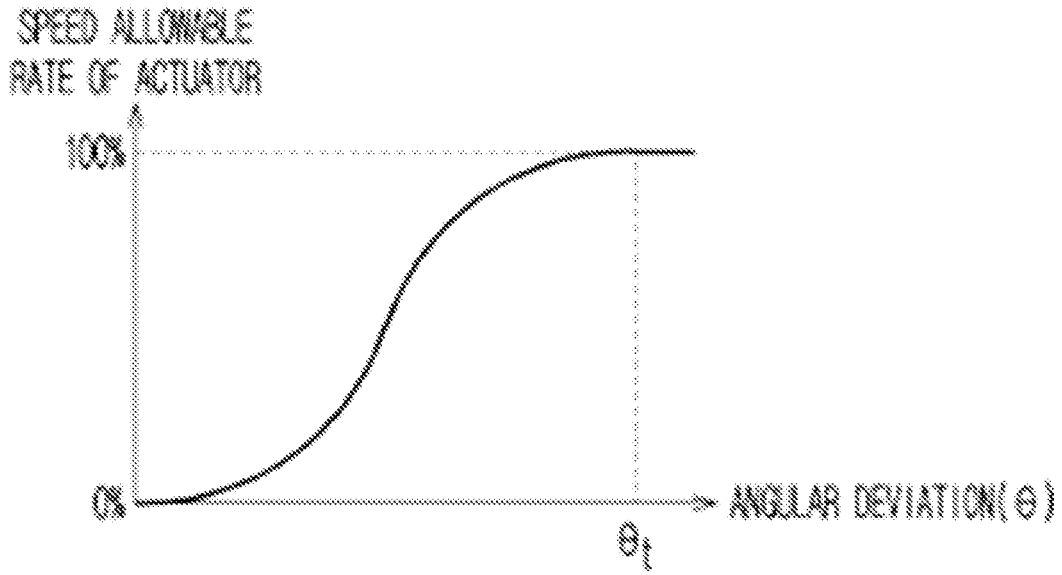
FIG. 6 is a view illustrating a speed allowable rate of an actuator according to an angle of the construction equipment according to another embodiment of the present disclosure.

Additionally, the electronic control unit 500 sets the deceleration rate of the bucket 13*c* in the speed limit section. In this case, the deceleration rate of the bucket 13*c* may be set linearly according to the angular deviation θ, but is not limited thereto, and may be set non-linearly as illustrated in FIG. 6.

Accordingly, the speed of the bucket 13*c* is controlled based on the deceleration rate in the speed limit section.

In other words, the electronic control unit 500 outputs the control signal to the control valve 100 based on the deceleration rate according to the angular deviation θ which is the difference between the angle ∠AOB of the current angle of the bucket 13*c* for the work area, and the angle ∠COB of the bucket 13*c* for the work area when the bucket 13*c* invades the work area, and the control valve 100 controls the hydraulic cylinder based on the control signal.

According to the present disclosure, when the turning radius L1 of the bucket 13*c* is greater than the distance between the rotating center O of the bucket 13*c* and the work area, the bucket is controlled based on the angular difference θ which is the difference between the current angle ∠AOB of the rotating center O of the bucket 13*c*, the distal end A of the bucket 13*c* and the work area, and the angle ∠COB of the rotating center O of the bucket 13*c*, the distal end A of the bucket 13*c* and the work area when the bucket 13*c* invades the work area, and accordingly, it is possible to operate the bucket 13*c* more efficiently when there is a lot of time left for the bucket 13*c* to invade the work area depending on the posture of the bucket 13*c* during the excavation of the bucket 13*c*.

Figure 5:
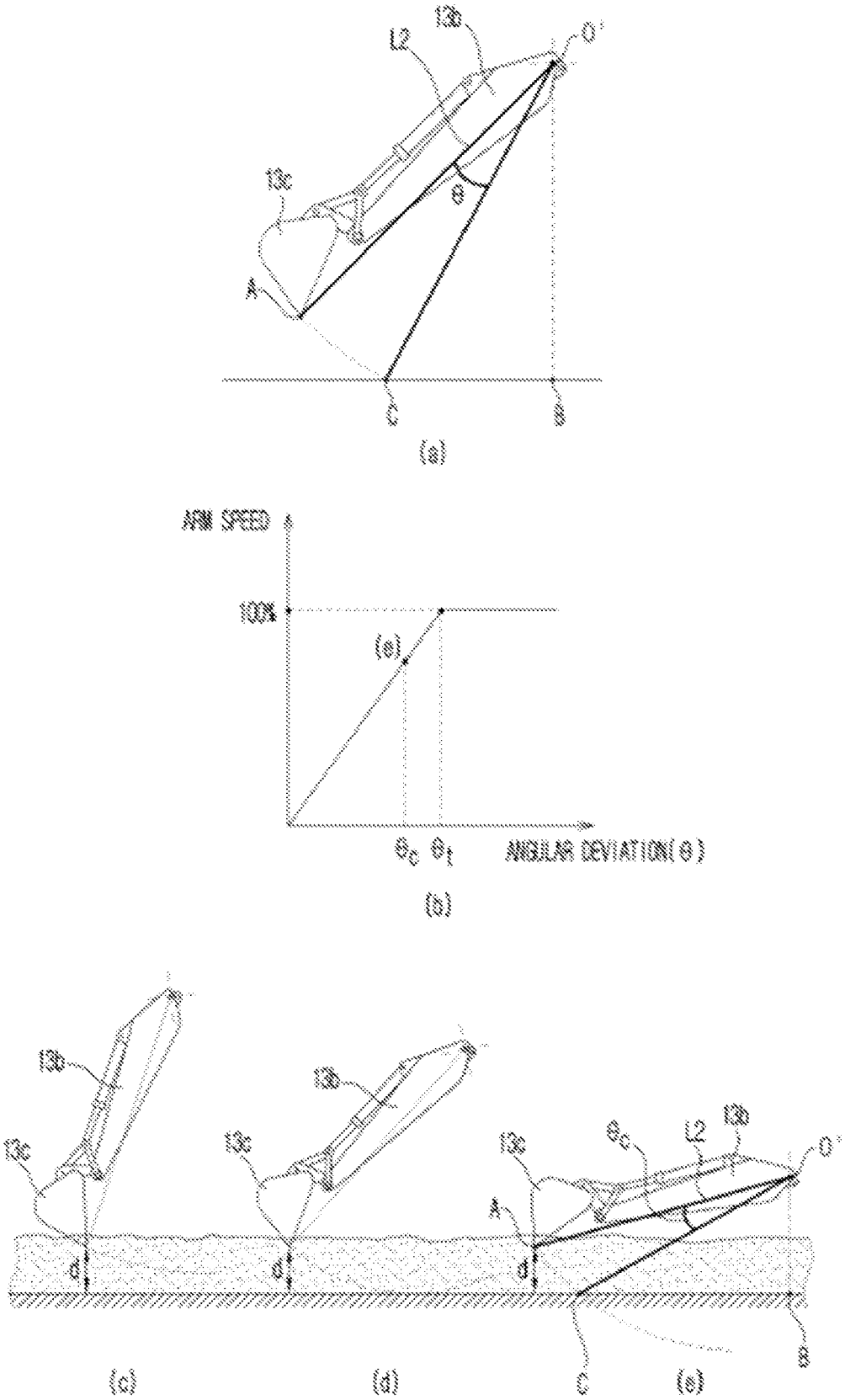
FIG. 5 is a schematic diagram illustrating a method for controlling the speed of the work machine during an arm-in operation of the construction equipment according to another embodiment of the present disclosure.

FIG. 5 is a schematic diagram illustrating a method for controlling the speed of the work machine 13 during the arm-in operation of the construction equipment according to another embodiment of the present disclosure.

Referring to FIGS. 3 and 5, the work machine with the work area limit function according to another embodiment of the present disclosure is operated in the following manner.

The another embodiment of the present disclosure is different from the previous embodiment in that the former has an arm pin O' as the rotating center of the work machine 13.

First, the driver selects an active control mode on the work setting unit 400, and sets a target work area. Additionally, the driver operates the arm-in operation lever 200 for the excavation work of the work area.

In this regard, the location information providing unit 300 collects and/or calculates the location information and posture information of the work machine 13 and/or the location information of the set work area, and provides the same to the electronic control unit 500. The electronic control unit 500 determines whether the work machine 13 is likely to invade the set work area based on the location information and posture information of the work machine 13 provided from the location information providing unit 300 and/or the location information of the set work area. Preferably, the electronic control unit 500 compares the turning radius of the bucket 13*c* for the arm pin O' with the distance between the arm pin O' and work area.

Specifically, FIG. 5(*c*) illustrates a case where the distance from an arm pin O' to the bucket end A, which is the turning radius L2 of the bucket 13*c* for the arm pin O', is smaller than the distance between the arm pin O' and the shortest point B to the work area. FIG. 5(*d*) illustrates a case where the turning radius L2 of the bucket 13*c* for the arm pin O' is the same as the shortest distance between the arm pin O' and the work area. FIG. 5(*e*) illustrates a case where the turning radius L2 of the bucket 13*c* for the arm pin O' is greater than the shortest distance between the arm pin O' and the work area.

The shortest distance d between the distal end A of the bucket 13*c* and the work area is the same in postures in FIGS. 5(*c*), 5(*d*) and 5(*e*). However, in case of FIGS. 5(*c*) and 5(*d*), since the turning radius L2 is the same as or smaller than the shortest distance between the rotating center O' and the work area, the work machine is not likely to invade the work area even when the arm 13*b* is operated. Nevertheless, when the speed of the arm 13*b* is limited based on the shortest distance d between the distal end A of the bucket 13*c* and the work area, the work speed and efficiency during the excavation work may deteriorate.

Therefore, it is necessary to compare the turning radius L2 of the work machine 13 with the distance between the work machine 13 and the work area to limit the speed of the bucket 13*c* only when the turning radius L2 of the work machine 13 is greater than the distance between the work machine 13 and the work area as illustrated in FIG. 5(*e*).

As such, when the electronic control unit 500 controls the speed of the arm 13*b* based on the turning radius of the work machine 13 and the distance between the work machine 13 and work area, even when the bucket 13*c* is located to be close from the work area, if the turning radius of the work machine 13 is likely to invade the work area, since the speed of the arm 13*b* is not limited by force, the work of a worker may be naturally linked.

Meanwhile, when it is determined that the bucket 13*c* is likely to invade the work area because the turning radius L2 of the bucket 13*c* for the arm pin O' is greater than the shortest distance between the arm pin O' and the work area, the speed of the arm 13*b* may be controlled based on the angle remaining until the bucket 13*c* invades the work area.

In other words, as illustrated in FIG. 5(*b*), the speed of the arm 13*c* may be controlled based on the deviation between the current angles of the bucket 13*c* and arm pin O' for the work area, and the angle of the bucket 13*c* and arm pin O' for the work area when invading the work area.

The electronic control unit 500 calculates the angular deviation θ (∠AO'C), which is the difference between the current angle ∠AO'B of the arm pin O', the distal end A of the bucket 13*c* and the shortest point B of the work area, and the angle ∠CO'B of the arm pin O', the distal end A of the bucket 13*c*, and the point C that first invades the work area when the bucket 13*c* rotates, based on the location information of the work machine 13 provided from the location information providing unit 300 and/or the location information of the set work area, and then compares the angular deviation θ with the predetermined reference value θt. In this case, the predetermined reference value θt may be, for example, 15°, but is not limited thereto.

The electronic control unit 500 determines that the speed of the arm 13*b* does not have to be limited when the angular deviation θ exceeds the predetermined reference value θt. In other words, in this case, the electronic control unit 500 does not limit the speed of the arm 13*b*.

Meanwhile, the electronic control unit 500 determines to be in a speed limit section when the angular deviation θc is less than or equal to the reference value θt as illustrated in FIG. 5(*c*).

Additionally, the electronic control unit 500 sets the deceleration rate of the arm 13*b* in the speed limit section. In this case, the deceleration rate of the arm 13*b* may be set linearly according to the angular deviation θ, but is not limited thereto, and may be set non-linearly as illustrated in FIG. 6.

Accordingly, the speed of the arm 13*b* is controlled based on the deceleration rate in the speed limit section.

In other words, the electronic control unit 500 outputs the control signal to the control valve 100 based on the deceleration rate according to the angular deviation θ which is the difference between the current angle ∠AO'B of the bucket 13*c* and arm 13*b* for the work area, and the angle ∠CO'B of the bucket 13*c* and arm 13*b* for the work area when the bucket 13*c* invades the work area, and the control valve 100 controls the hydraulic cylinder based on the control signal.

According to the present disclosure, when the turning radius L2 of the bucket 13*c* for the arm pin O' is greater than the distance between the arm pin O' and the work area, the speed of the arm 13*b* is controlled based on the angular difference θ which is the difference between the current angle ∠AO'B of the arm pin O', the distal end A of the bucket 13*c* and the work area, and the angle ∠CO'B of the arm pin O', the distal end A of the bucket 13*c* and the work area when the bucket 13*c* invades the work area, and accordingly, it is possible to operate the arm 13*b* more efficiently when the bucket 13*c* does not invade the work area or there is a lot of time left for the bucket 13*c* to invade the work area depending on the posture of the arm 13*b* during the excavation.

Figure 7:
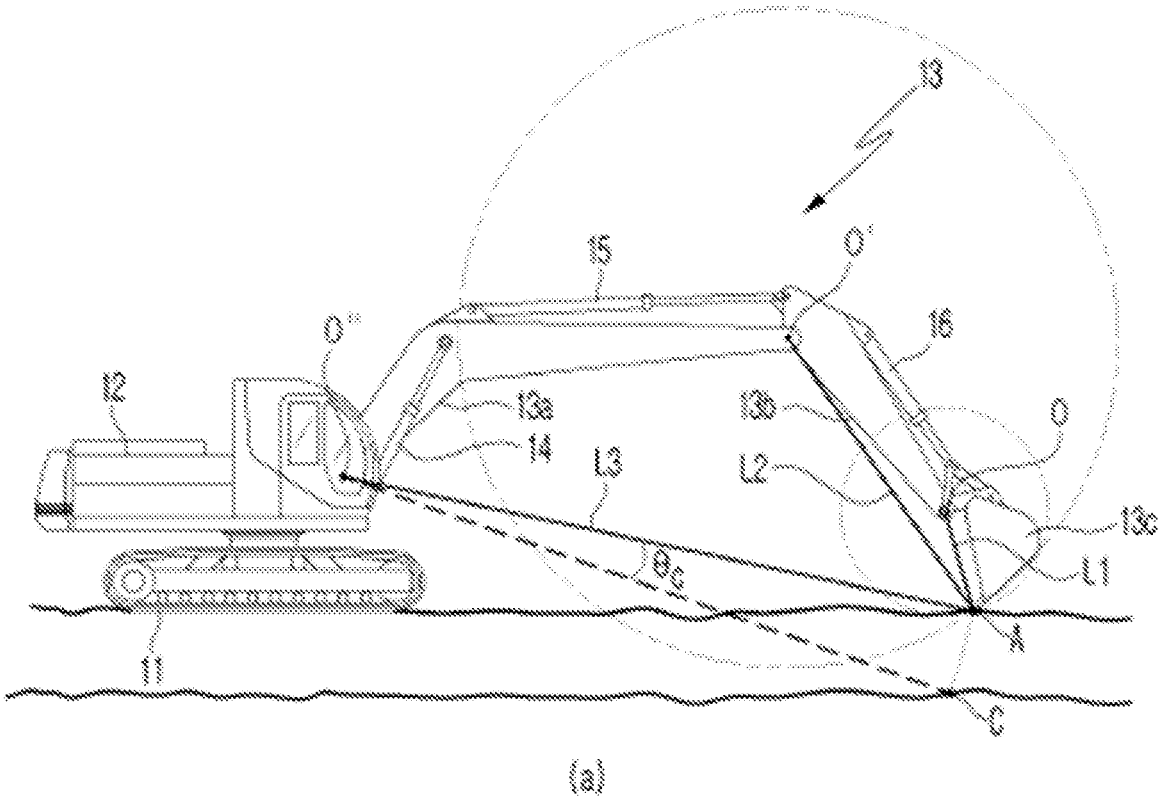
FIG. 7 is a schematic diagram illustrating a method for controlling the speed of the work machine in case of operating the work machine of the construction equipment according to another embodiment of the present disclosure.
Figure 7:
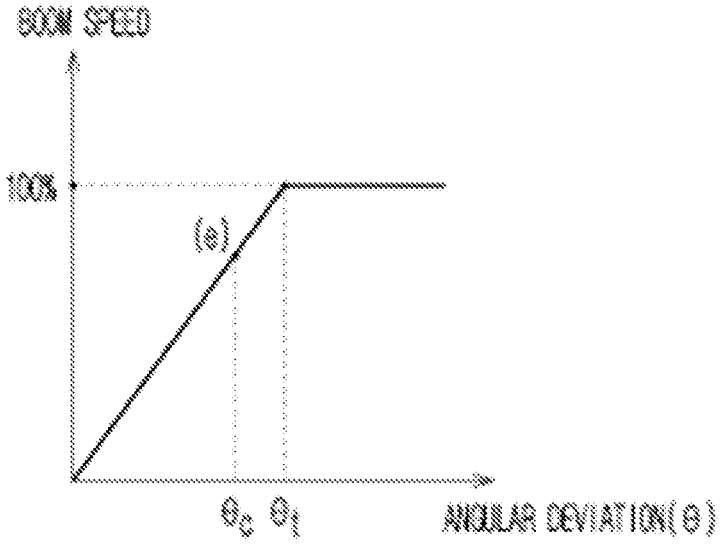

The another embodiment of the present disclosure is different from the previous embodiment in that the former has a boom pin O" as the rotating center of the work machine 13. As illustrated in FIG. 7, when the turning radius L3 of the distal A of the bucket 13*c* for the boom pin O" is greater than the distance between the boom pin O" and the work area, it is determined that the bucket is likely to invade the work area.

Specifically, the electronic control unit 500 calculates the angular deviation θc between the current angle of the bucket 13*c* and boom pin O" for the work area, and the angle of the bucket 13*c* and boom pin O" when invading the work area, based on the location information and posture information of the work machine 13 provided from the location information providing unit 300 and/or the location information in the set work area to compare the same with the predetermined reference value θt, and controls the speed of the boom 13*a* when the calculated angular deviation is less than or equal to the predetermined reference value θt. In this case, the predetermined reference value θt may be, for example, 15°, but is not limited thereto.

The electronic control unit 500 determines that the speed of the boom 13*a* does not have to be limited when the angular deviation θ exceeds the predetermined reference value θt. In other words, in this case, the electronic control unit 500 does not limit the speed of the boom 13*a*.

Meanwhile, the electronic control unit 500 determines to be in a speed limit section when the angular deviation θc is less than the reference value θt as illustrated in FIG. 7(*b*).

Additionally, the electronic control unit 500 sets the deceleration rate of the boom 13*a* in the speed limit section. In this case, the deceleration rate of the boom 13*a* may be set linearly according to the angular deviation θ, but is not limited thereto, and may be set non-linearly as illustrated in FIG. 6.

Accordingly, the speed of the boom 13*a* is controlled based on the deceleration rate in the speed limit section.

In other words, the electronic control unit 500 outputs the control signal to the control valve 100 based on the deceleration rate according to the angular deviation θ, and the control valve 100 controls the hydraulic cylinder based on the control signal.

According to the present disclosure, when the turning radius L3 of the bucket 13*c* for the boom pin O" is greater than the distance between the boom pin O" and the work area, the speed of the boom 13*a* is controlled based on the angular difference θ, and accordingly, it is possible to operate the boom 13*a* more efficiently when the bucket 13*c* does not invade the work area or there is a lot of time left for the bucket 13*c* to invade the work area depending on the posture of the boom 13*a* during the excavation.

The another embodiment of the present disclosure is different from the previous embodiment in that the former considers the boom pin O", the arm pin O' and the bucket pin O at the same time as the rotating center of the work machine 13. Specifically, the shortest distance from the turning radius, which is the distance between the distal end A of the bucket 13*c* and each rotating center, to the work area from each rotating center is compared, and when the turning radius in any one of the three cases is greater than the shortest distance, it is determined that the bucket 13*c* is likely to invade the work area. Additionally, the work machine 13, determined to be likely to invade the work area, may be controlled based on the angle remaining until invading the work area.

For example, as illustrated in FIG. 7, assuming that the driver operates at least one of the boom 13*a*, the arm 13*b* and the bucket 13*c* for excavating the work area, since the turning radius L1 of the bucket 13*c* for the bucket pin O is smaller than the shortest distance between the bucket pin O and the work area, and the turning radius L2 of the bucket 13*c* for the arm pin O' is smaller than the shortest distance between the arm pin O' and the work area, the speed of the arm 13*b* and the bucket 13*c* does not have to be limited.

However, since the turning radius L3 of the bucket 13*c* for the boom pin O" is greater than the shortest distance between the boom pin O" and the work area, the speed of the boom 13*a* may be controlled based on the angle remaining until the bucket 13*c* invades the work area.

As such, when the speed of the work machine 13 which is likely to invade the work area is controlled considering the boom pin O", the arm pin O', and the bucket pin O at the same time as the rotating center of the work machine 13, it is possible to operate the work machine 13 more efficiently when the bucket 13*c* does not invade the work area or there is a lot of time left for the bucket 13*c* to invade the work area depending on the posture of the work machine during the excavation.

The foregoing description of the present disclosure has been presented for illustrative purposes, and it is apparent to a person having ordinary skill in the art that the present disclosure can be easily modified into other detailed forms without changing the technical idea or essential features of the present disclosure. Therefore, it should be understood that the forgoing embodiments are by way of example only, and are not intended to limit the present disclosure. For example, each component which has been described as a unitary part can be implemented as distributed parts. Likewise, each component which has been described as distributed parts can also be implemented as a combined part.

The scope of the present disclosure is presented by the accompanying claims, and it should be understood that all changes or modifications derived from the definitions and scopes of the claims and their equivalents fall within the scope of the present disclosure.

10: construction equipment
100: control valve
200: operation lever
300: location information providing unit
400: work setting unit
500: electronic control unit

What is claimed is:

1. A construction equipment, comprising:

a lower traveling body;

an upper rotating body rotatably supported on the lower traveling body;

a work machine which comprises a boom, an arm, and a bucket operated a hydraulic cylinder, wherein the work machine is supported by the upper rotating body;

a control valve for controlling the hydraulic cylinder;

an operation lever for outputting an operation signal corresponding to an operation amount of a driver;

a work setting processing unit for setting a work area of the work machine;

a location information providing unit for providing at least one of location information and posture information of the work machine and location information of the work area; and an electronic control unit for outputting a control signal for the control valve according to the signal inputted from at least one of the operation lever, the work setting processing unit, and the location information providing unit, wherein the electronic control unit calculates an angle between the work area and the work machine, and controls a speed of the work machine based on the calculated angle, wherein the electronic control unit controls the speed of the work machine based on an angle remaining to the work area of the work machine, wherein the angle remaining to the work area of the work machine is proportional to the speed of the work machine, wherein the electronic control unit determines to be in a speed limit section when a difference between a current angle of the work machine for the work area and an angle of the work machine for the work area when the bucket invades the work area is less than or equal to a predetermined reference value.

2. The construction equipment according to claim 1, wherein when the operation signal of the operation lever is inputted, the electronic control unit determines whether the turning radius of the work machine is likely to invade the work area and limits the speed of the work machine only when the work machine is likely to invade the work area.

3. The construction equipment according to claim 2, wherein the electronic control unit compares the turning radius with a shortest distance between a rotating center of the work machine and the work area to limit the speed of the work machine when the turning radius is greater than the shortest distance.

4. The construction equipment according to claim 3, wherein the turning radius is a line connecting the rotating center and a distal end of the bucket.

5. The construction equipment according to claim 4, wherein the rotating center is at least one of a boom pin, an arm pin and a bucket pin.

6. The construction equipment according to claim 1, wherein the electronic control unit sets a deceleration rate of the work machine in the speed limit section, and limits the speed of the work machine based on the set deceleration rate.

7. The construction equipment according to claim 6, wherein the electronic control unit sets the speed limit section and/or deceleration rate based on the difference in angle.

8. The construction equipment according to claim 1, wherein the location information providing unit comprises at least one of a location measurement unit for measuring location information of the construction equipment, a posture measurement unit for measuring posture information of the construction equipment and posture of the work machine, and a coordinate calculation processing unit for calculating coordinates based on the location information measured from the location measurement unit and the posture measurement unit.

9. The construction equipment according to claim 1, wherein the operation lever is an electric joystick that generates an electric signal in proportion to the operation amount of the driver and provides the electric signal to the electronic control unit.

10. The construction equipment according to claim 1, wherein the work setting processing unit comprises a plurality of work mode setting functions which can be set as needed by the driver, and display on a display screen at least one of geographic information and location information provided from the location information providing unit, and posture information of the construction equipment according to the work mode setting.

* * * * *